United States Patent [19]

Tison

[11] Patent Number: 4,688,485

[45] Date of Patent: Aug. 25, 1987

[54] METHOD AND DEVICE FOR HIGH SPEED PRINTING

[75] Inventor: Eric Tison, Perthes, France

[73] Assignee: Codimag, Perthes, France

[21] Appl. No.: 711,377

[22] Filed: Mar. 13, 1985

[30] Foreign Application Priority Data

Mar. 15, 1984 [FR] France ..... 84 04007

[51] Int. Cl.[4] ..... B41F 13/00

[52] U.S. Cl. ..... 101/426; 101/181; 101/228

[58] Field of Search ..... 101/219, 228, 178, 181, 101/426

[56] References Cited

U.S. PATENT DOCUMENTS

| | | | |
|---|---|---|---|
| 4,066,016 | 1/1978 | Tison | 101/219 X |
| 4,129,238 | 12/1978 | Herd | 101/228 X |
| 4,372,206 | 2/1983 | Tison et al. | 101/228 |

FOREIGN PATENT DOCUMENTS

| | | | |
|---|---|---|---|
| 68522 | 7/1914 | Austria | 101/219 |
| 1361454 | 4/1964 | France . | |
| 2100672 | 1/1983 | United Kingdom | 101/219 |

*Primary Examiner*—Edgar S. Burr
*Assistant Examiner*—Moshe I. Cohen
*Attorney, Agent, or Firm*—Gifford, Groh, VanOphem, Sheridan, Sprinkle and Dolgorukov

[57] ABSTRACT

A printing device includes a plate carrying cylinder in contact with a printing transfer cylinder two or three times its circumference. Two pressure cylinders are movable between a withdrawn position and a use position where they maintain a web in printing contact with the printing transfer cylinder at two distinct positions, for forming two impressions on the web during one cycle. A method for printing in accordance with the device is also disclosed.

12 Claims, 2 Drawing Figures

METHOD AND DEVICE FOR HIGH SPEED PRINTING

BACKGROUND OF THE INVENTION

The invention relates to a method and device for high speed printing.

More precisely it is applicable to a printing technique in which impressions are made onto successive portions of a web, each portion having a predetermined length known as the format of the web, the web being permanently pulled at a take-up speed and being printed in successive cycles, each cycle comprising a printing phase during which the web is printed onto whilst imposing on the printed portion a feed speed called the printing speed which is greater than the take-up speed and a following phase during which the speed of the web is modified for repositioning the web for the following cycle.

It is known for repositioning the web, to withdraw the web backwards during a portion of the phase following printing, this withdrawal being made with a speed all the more significant as little time is available for repositioning the web. This technique submits the web to jerks which hinders speed.

THE INVENTION

The present invention proposes a technique which permits repositioning of the web whilst avoiding any stopping and any returning backwards of the web whilst obtaining web formats exactly in position.

This is obtained, according to the present invention, by drawing, per cycle, a length of web corresponding to two web formats and making, per cycle, two simultaneous impressions.

In a typical embodiment, a rotary printing transfer cylinder is used onto which the impression is transferred from a cylinder and the take-up speed is regulated so that during the duration of two rotations of the said cylinder, the length of web taken up is equal to two web formats.

The printing transfer cylinder can be either a blanket using wet or dry offset or a letterpress cylinder, or a gravure cylinder.

According to the invention, two printing contacts between the web and the printing transfer cylinder are provided during the printing phase whilst adjusting the duration of these contacts as a function of the web format.

In an advantageous embodiment, a speed upstream of the printing is applied to the web which is in the same direction as the take-up speed but which is lower than the take-up speed.

BRIEF DESCRIPTION OF THE DRAWINGS

A better understanding of the present invention may be had upon reference to the following detailed description of the embodiments, when read in conjunction with the accompanying drawing, wherein like reference characters refer to like parts throughout the views, and in which.

THE EMBODIMENTS

Figure 1:
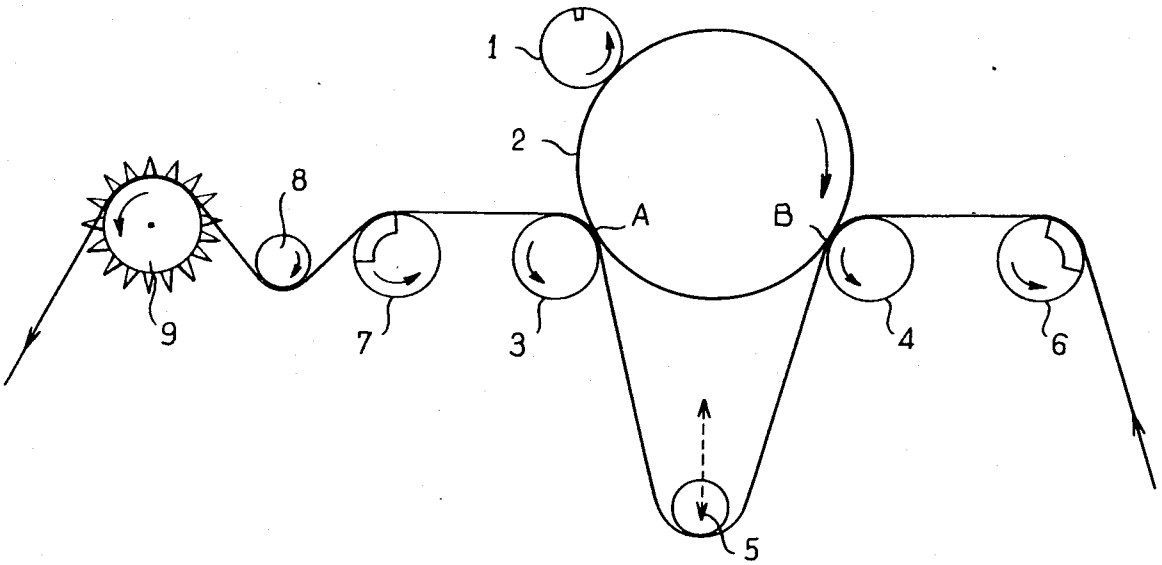
FIG. 1 is a schematic view of a first preferred embodiment of the present invention.

The devices each comprise a plate-carrying cylinder 1 in printing contact with a blanket-carrying cylinder 2 and means 3 to 9 which define a web path passing in immediate proximity to the cylinder 2.

These means comprise two rotary pressure cylinders 3,4 simultaneously movable between a withdrawn position and a use position (which is shown in the Figures) where they bring the web into contact with the cylinder 2 in two distinct contact points A and B which are separated on the cylinder 2 by a length equal to the developed length of the plate-carrying cylinder 1 and which are separated on the web by a web length equal to three web formats. The means for arranging this web length between the contact zones A and B are constituted for example by one or more rollers 5 which cause the web to form a loop between these contacts.

The web is permanently taken-up in the direction of feed by means of a rotary take-up drive 9 of which the speed is regulated by a pinion determined by the format, for example a sprocket wheel drive arranged downstream of the cylinder 2 and which will be called the take-up device.

The system described, with a take-up device provided with sprockets using the perforations in the paper web, is a particular application to a continuous machine. The paper could equally be drawn in a known manner, on a smooth cylinder with two application rollers.

In addition, vacuum cylinders 6,7 are arranged respectively upstream and downstream of the cylinder 2 as will be explained below.

The duration of a cycle is defined as the time necessary for two complete rotations of the plate carrying cylinder 1.

The duration of the printing phase is that necessary for printing of the printing transfer cylinder 2 by the plate of the plate-carrying cylinder 1: this duration of the printing phase is at the most equal to one rotation of the plate-carrying cylinder 1; it is thus at the most equal to the duration of a half-cycle and there thus remains at least the duration of a half-cycle for reabsorbing the loop which will be formed during the printing phase between the printing transfer cylinder 2 and the take-up device 9.

In practice, the length of the printing plate is always at least slightly less than the developed length of the plate-carrying cylinder 1 because a fraction of this developed length corresponds to the slit holding the plate on the cylinder. For example, for a 13 inch cylinder, the maximum printing format is 12 inches but it can be much reduced, for example 8 inches.

Figure 2:
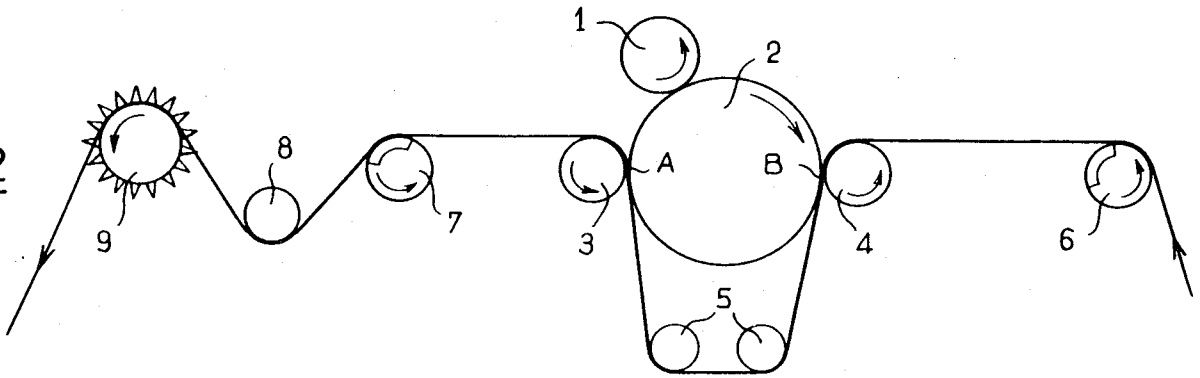
FIG. 2 is a schematic view of a second preferred embodiment.

The printing transfer cylinder 2 normally has a developed length which is two or three times the developed length of the plate-carrying cylinder 1. For a plate-carrying cylinder of 13 inches, the developed length of the printing transfer cylinder is then 39 inches (FIG. 1) or 26 inches (FIG. 2). Preferably the pressure cylinders 3,4 have the same developed length as the plate-carrying cylinder, which is for example 13 inches.

The device shown in FIG. 1 functions in the following manner.

If one considers one cycle, during the duration of this cycle:

the plate-carrying cylinder makes two turns;

the printing transfer cylinder makes two-thirds of a turn; and the take-up device takes up two web formats.

If one now breaks down the cycle into phases:

the printing phase begins for example at the beginning of the first turn of the plate-carrying cylinder and the pressure cylinders come into action at this moment. The bringing into action of the pressure cylinders passes the web from the take-up speed to the printing speed. If the cylinder 7 is given a speed slightly greater than the printing speed, the web remains tensioned between the pressure cylinder 3 and the cylinder 7 but forms a loop between the cylinder 7 and the take-up device 9 because the printing speed is greater than the speed of the take-up device. It is this loop which must be reabsorbed after the printing phase.

The end of the printing phase is defined as the moment when a format of printing has been transferred to the printing cylinder 2 by the plate of the plate-carrying cylinder 1. At this moment, the pressure cylinders 3 and 4 are released.

After the printing phase, the plate-carrying cylinder 1 ends its rotation (if need be) and makes again a complete rotation but the pressure cylinders remain released. At the end of this complete rotation, the cycle is finished.

The linear speed of the printing transfer cylinder, of the plate-carrying cylinder and of the pressure cylinders 3 and 4 is the same. During the printing phase, the printing transfer cylinder 2 makes a fraction of a turn which corresponds to one printing format and, as the cylinder has a developed length equal to three times that of the plate-carrying cylinder and the printing format is at a maximum equal to one developed length of the plate-carrying cylinder, the rotation of the printing transfer cylinder during the printing phase is at a maximum one third of a turn and the rotation of the printing transfer cylinder during the totality of a cycle corresponds to two rotations of the plate-carrying cylinder: the rotation of the printing transfer cylinder during a cycle is then two-thirds of a turn which breaks down as follows:

at a maximum, one-third of a turn during the printing phase, at a minimum, one-third of a turn during the rest of the cycle.

This second third permits the re-inking of the printing transfer cylinder, after which a new cycle can be made, the parts of the blanket upstream of the pressure cylinders 3 and 4 being suitably inked.

If the means forming the loop 5 is adjusted so that the web loop between the two pressure cylinders 3 and 4 represents three times the size of one web format, this loop contains, at the end of one printing phase, two printed web formats separated by one non-printed web format.

When the printing phase is finished, the pressure cylinders free the web and continue to do so during the rest of the cycle. The vacuum cylinder 6 turning at slow speed in the direction of movement of the web brings about retightening of the web on the cylinder 8; the sprocket takeup device 9 retakes up the movement of the web at the takeup speed pending a new bringing to pressure of the pressure cylinders 3 and 4.

The vacuum cylinder turns at a speed three to four times less than the speed of the take-up device 9. When the web is tensioned again, it slides on the cylinder 6, the vacuum having only the effect of regulating the tension of the web.

The length of the loop of web between the two impression contacts is normally three web formats but it can be a greater number.

A device according to the invention typically permits 24,000 impressions per hour to be obtained for a web movement which corresponds only to half that, that is to say 12,000 cycles per hour.

The vacuum cylinder 7 also turns in the direction of feed of the web at a speed slightly greater than the printing speed. Its suction effect is weaker than half that of the cylinder 6. The cylinder 7 is useful for unsticking the web from the blanket in the printing phase and for maintaining a suitable tension in the last phase of the cycle.

Thus, the movement of the web is made in a complete cycle, according to three different speeds:

(a) the take-up speed (or "web format" speed) given by the take-up device 9 and variable as a function of the pinion employed;

(b) a printing speed given by the bringing to pressure of the pressure cylinders 3 and 4 on to the blanket 2;

(c) a retensioning speed given by the vacuum cylinder 6 during the phase when the pressure cylinders are released and before the return to the take-up speed of the take-up device 9.

The movement "in" and "out" of pressure of the cylinders 3 and 4 is effected by a cam synchronised with the movement of the blanket. The cam is adjustable in lift for adjusting the bringing into or out of pressure as a function of the desired format of printing.

In the embodiment of FIG. 2, the printing cylinder is such that its developed length corresponds only to two times the developed length of the plate-carrying cylinder 1. The two pressure cylinders 3 and 4 are thus diametrically opposed so that the contact points are separated by the size of one printing format supposing that this format corresponds to the developed length of the plate-carrying cylinder.

For changing the take-up speed, in other words for changing the web format when this format is adjusted by the take-up speed, it suffices to choose one of several gearings of the transmission between the prime mover and the sprocket drive.

EXAMPLE (In this example, the dimensions are expressed in inches (″))

A machine having a plate-carrying cylinder of 13″ and a blanket-carrying cylinder $3\times13''=39''$ is used.

The 13″ pressure cylinders 3 and 4 are constructed with a flat part of 1″. This 1″ neutral part serves to provide the necessary time for the bringing into pressure of the two cylinders 3 and 4. This 1″ flat part is always synchronised with the bringing into pressure at the beginning of this cycle. As a result, the bringing into pressure is clean, the paper web is drawn following a well-defined generatrix.

The format of the paper and of the printing may be supposed to be 12″.

For one turn of the 13″ cylinder 1, the take-up device 9 takes up 12″ of paper. The adjustment of the take-up device 9 to the 12″ format is made by means of gearing arranged in a known "swing frame" system. This system permits a choice of different diameters of gearing, the minimum variation being represented by one gear tooth; in this example, the gear tooth represents 1/6 of an inch, but it may be ⅛ of an inch or in millimeters. Other equally known means may be employed such as a speed variator or electronic control of motors.

On the blanket-carrying cylinder, the points of contact A and B of the pressure cylinders are separated by 13". This distance remains the same in all formats.

For a 12" format, the printing phase will be 12/13ths of the rotation of the plate-carrying cylinder 1 after which the pressure cylinders 3 and 4 will be released.

During this printing phase, the take-up device 9 will take up 12/13ths of 12", that is: 11.076,922" of paper.

There will be formed around the cylinder 8 a loop of paper of a little less than 1". This loop will be reabsorbed during the following phase, which corresponds to 1/13th of a turn of the printing cylinder plus a complete turn of this cylinder, that is a total of 14/13ths.

If the paper web were blocked straight after the printing phase, the 1" loop would be reabsorbed in 1/13th of a turn of the cylinder. To avoid sharp shocks on the web (instantaneous stopping and starting), the braking cylinder 6 is adjusted to a speed less than the take-up speed of the take-up device 9.

In this example, it is of 4" for a drawing of the takeup device of 12" of paper, for a complete cycle of paper, twice 12", that is 24"; for the cylinder 6, the speed will be two times 4", that is 8".

The cylinder 7 is intended to maintain the tension of the web during the printing phase and the take-up of the paper. Its speed is slightly greater than the printing speed for assuring a suitable tension on change of speed.

Its acceleration with respect to the printing cylinder is of the order of 1 to 1½%, the cylinder being evacuated, the paper is always sliding on the cylinder.

Supposing that one turn of the printing cylinder corresponds to a second, that is 2 seconds for a complete cycle, the printing phase will correspond to 12/13ths of a second and the take-up phase of the format to 14/13ths of a second, in the case of an adjustment to the 12" format.

In the case of an 8" format, the printing phase will be 8/13ths of a turn of the plate-carrying cylinder 1, the take-up device 9 will draw 8/13ths of its 8" format or 4.923", and the loop formed about the cylinder 8 will be a little greater than 3". The length remaining in the cycle will be 18/13ths of a turn of the plate-carrying cylinder 1 expressed in time in the example of 1 second for one turn of the cylinder 1: then the values will be 8/13ths of a second for the printing phase and 18/13ths of a second for the taking-up phase.

The repositioning of the paper corresponds to the moment where the web is retensioned on the cylinder 8. The web takes the take-up speed of the take-up device 9 and permits precise restarting of the printing phase.

The bringing into action of the pressure cylinders 3 and 4 operates by means of a cam adjusted in amplitude in a manner known in itself.

For adjusting the machine to a determined format, it is necessary to:

(1) engage the gearing corresponding to the format for the take-up device 9, (2) adjust the length of the cam suitable for maintaining in pressure the pressure cylinders 3 and 4 for the length of format chosen, (3) position the cylinder 5 so that it provides in the paper web a length of three times the chosen format.

I claim:

1. A device for printing an impression on a web, said impression having a length equal to a web format, said device comprising:

a printing transfer cylinder; and means for imposing an impression of said web to be printed on a course passing in immediate proximity to said printing transfer cylinder, said means for imposing comprising:

take-up means disposed downstream of said printing transfer cylinder for continuously drawing said web with a predetermined constant take-up speed in one direction, two pressure cylinders movable between a withdrawn position and a use position wherein said two pressure cylinders maintain said web in printing contact with said printing transer cylinder at two contact points during a printing phase, means for increasing the speed of said web as it contacts said printing transfer cylinder during said printing phase, said speed increasing means forming a slack portion of said web between said take-up means and said transfer cylinder during said printing phase, and means for retensioning said slack portion of said web including a first rotary vacuum means positioned upstream of said printing cylinder and before said take-up means, means for rotating said first rotary vacuum means in said one direction at a second predetermined speed less than said constant take-up speed of said take-up means.

2. A device for printing according to claim 1, comprising a plate cylinder in contact with said printing transfer cylinder for receiving said impression, said plate cylinder having a developed length, said two pressure cylinders being arranged with respect to said printing transfer cylinder so that said two contact points are separated by a sector of said printing transfer cylinder representing said developed length of plate cylinder.

3. A device for printing according to claim 2, wherein said plate cylinder has a developed length equal to a third of the length of said printing transfer cylinder.

4. A device according to claim 1, comprising means for causing a loop of said web to form between said two contact points, said loop having a length equal to at least three web formats.

5. A device according to claim 1, comprising a second rotary vacuum means positioned downstream of said printing cylinder turning in said one direction of said web during said printing phase and maintaining a suitable tension in said web after said printing phase.

6. A device for printing according to claim 2, wherein said plate cylinder has a developed length equal to a half of the length of said printing transfer cylinder.

7. A method for printing successive impressions on a web with a transfer cylinder, each web having a predetermined web format, said method comprising;

drawing said web to a take-up drum at a predetermined constant take-up speed;

printing two impressions simultaneously on said web with said transfer cylinder during a printing phase of a cycle;

imposing a feed speed on said web along said transfer cylinder, said feed speed being greater than said take-up speed during said printing phase;

forming a slack portion in said web between said take-up drum and said transfer cylinder during said printing phase;

reducing the speed of the web along said transfer cylinder during a repositioning phase of said cycle; and absorbing said slack portion of said web on said take-up drum during said repositioning phase.

8. The method of printing according to claim 7, said drawing step further comprising:

adjusting said take-up speed so that a length of web equal to two web formats is drawn during two rotations of a plate cylinder.

9. The method of printing according to claim 8, wherein said printing step further comprises:

contacting said transfer cylinder at two places simultaneously with said web;

adjusting the duration of said contacting step in relation to said web format.

10. The method of printing according to claim 9, wherein said printing step further comprises:

separating said two places of contact of said web along said transfer cylinder a distance equal to a developed length of said plate cylinder.

11. The method of printing according to claim 10, after the said step of adjusting said take-up speed and before the step of contacting, further comprising:

forming a loop of web between said two places of contact, said loop having a length equal to at least three web formats.

12. The method of printing according to claim 7, after said imposing step further comprising:

slowing the speed of the web approaching said transfer cylinder from upstream.

* * * * *